United States Patent [19]

Di Gesu'

[11] 4,241,830

[45] Dec. 30, 1980

[54] PACKING SYSTEM

[75] Inventor: Giovanni Di Gesu', Palermo, Italy

[73] Assignee: Indesit Industria Elettrodomestici Italiana S.p.A., Italy

[21] Appl. No.: 11,151

[22] Filed: Feb. 12, 1979

[30] Foreign Application Priority Data

Feb. 20, 1978 [IT] Italy ..... 67342 A/78

[51] Int. Cl.[3] ..... B65D 71/00

[52] U.S. Cl. ..... 206/422; 217/26.5; 229/2.5 R; 220/410

[58] Field of Search ..... 206/499, 501, 503, 509, 206/511, 515, 821, 418, 419, 485, 585, 521, 819, 420, 421, 422; 220/406, 410; 217/26.5

[56] References Cited

U.S. PATENT DOCUMENTS

| | | | |
|---|---|---|---|
| 3,416,690 | 12/1968 | Michael | 206/503 |
| 3,469,686 | 9/1969 | Gutsche et al. | 206/518 |
| 3,583,559 | 6/1971 | Brander | 217/26.5 X |
| 3,589,511 | 6/1971 | Britt | 206/65 |
| 3,709,325 | 1/1973 | Gordon et al. | 220/410 X |
| 3,799,386 | 3/1974 | Madalin et al. | 220/410 X |
| 3,933,295 | 1/1976 | Congleton | 206/518 |

FOREIGN PATENT DOCUMENTS

| | | | |
|---|---|---|---|
| 1060535 | 4/1954 | France | 206/515 |

*Primary Examiner*—Davis T. Moorhead

*Attorney, Agent, or Firm*—Lerner, David, Littenberg & Samuel

[57] ABSTRACT

A packing system for storing and transporting one or more cathode ray tubes, comprises at least one shell having one or more recesses. Each recess is shaped to accommodate as a good fit part of the glass bulb of a cathode ray tube and is of sufficient depth to retain the bulb firmly in position. The shell is of such a strength that it can by itself withstand bending stress exerted by the weight of the cathode ray tube.

23 Claims, 4 Drawing Figures

PACKING SYSTEM

The present invention relates to a packing system for storing and transporting one or more cathode ray tubes.

Various systems are known for packing cathode ray tubes. The one most commonly used by cathode ray tube manufacturers in Europe consists of a single container for accommodating eight cathode ray tubes, comprising a cardboard box in the shape of a parallelepiped with two polystyrene foam supports smaller than the box so they can be inserted inside. The supports are also paralleliped in shape with a square base measuring roughly 1 sq.m in area and 10 cm in height.

The supports, which in view of their dimensions, will be referred to hereafter as "sheets" are moulded to form recesses in each of which a part of the glass bulb of a cathode ray tube is housed.

Packing is carried out as follows: one of the polystyrene foam sheets is lowered into the bottom of the cardboard box; the cathode ray tubes are then inserted so that the part of the bulb comprising one side of the screen fits into the appropriate recess in the sheet (the neck of the cathode ray tube is horizontal with no provision for support); and then, a second sheet, identical to the first, is placed on top of the eight cathode ray tubes and the box is sealed.

The strength and compactness of the system therefore depends on the interaction of the forces exerted by the box, cathode ray tubes and polystyrene foam sheets.

The strength of the whole system depends on the cardboard box whereas the polystyrene sheets with their moulded recesses are designed to keep the cathode ray tubes in position and separate from one another inside the box.

This type of packing has two drawbacks.

The first has to do with the heavy weight of the cathode ray tube. It is not uncommon for the sides of the box to give way due to shock and for the glass bulbs to be jolted out of their seats. The result can easily be imagined.

The second is of an economic-organizational nature. For a clear understanding of this second drawback, it is important to realise, first of all, that there is very often a considerable distance between the plant in which the cathode ray tube is manufactured and the one in which it is actually assembled in a television receiver. Consequently, the supply of cathode ray tubes to television manufacturers entails long-term use of transport, such as trains or trailers.

This time factor not only applies to the outgoing (supply) journey but also the return run. Since the high cost of manufacturing this type of packing makes scrapping after use uneconomical, the means of transport used for supply is also used for returning the empties. The drawback of the system consists in the fact that the type of packing described above occupies the same space whether it is full or empty. Consequently, the means of transport used for recovering the empties returns with a full load so it cannot be used for carrying other material.

It would be equally uneconomical to reduce capacity by disassembling the carboard box as this requires the use of labour both for disassembling at one end and reassembling at the other.

An object of the present invention is to provide a packing system for cathode ray tubes in an improved form.

According to the present invention there is provided a packing system for storing and transporting one or more cathode ray tubes, comprising at least one shell having one or more recesses, each being shaped to accommodate as a good fit at least part of the glass bulb of a cathode ray tube, and each being of sufficient depth to retain the bulb firmly in position. The shell being of such a strength that it can by itself withstand bending stress exerted by the weight of a cathode ray tube.

A detailed description will now be given with reference to the attached drawings, provided by way of a non-limiting example in which.

Figure 1:
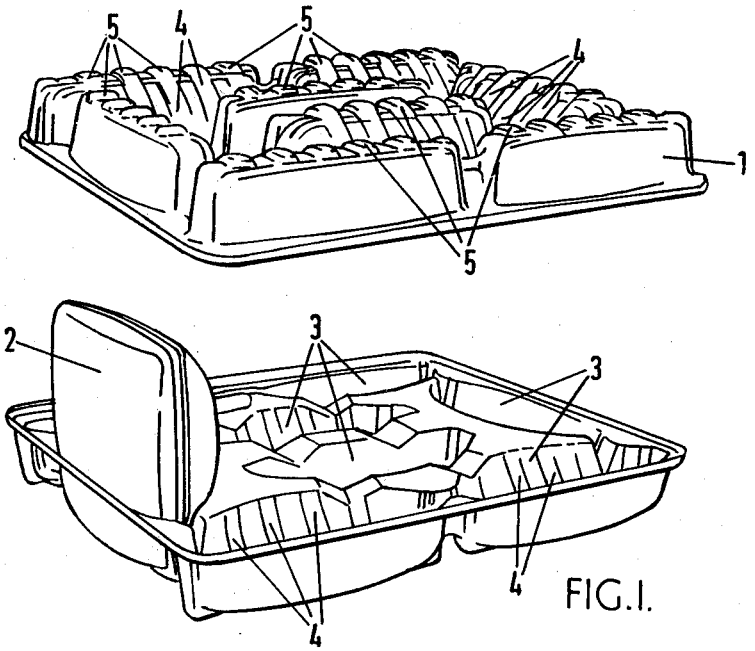
FIG. 1 shows a view in perspective of a cathode ray tube packing system according to the present invention.

Referring to FIG. 1 there is shown therein a packing system, comprising two shells 1 for accommodating eight cathode ray tubes 2. The two shells 1 are identical to one another. Each shell 1 is elongated and has eight elongated recesses which are each shaped to accommodate part of a cathode ray tube bulb. A pair of longitudinally aligned recesses are formed adjacent to each of the two longitudinal edges of the shell. Each shell also has at each end a recess extending transversely of the shell and a further pair of spaced parallel, longitudinally extending recesses formed in a central portion of the shell.

It is important to note that the recesses in these shells are deeper than those in known systems for packing cathode ray tubes (as hereinbefore described).

Also, the recesses are not formed in a thick element. Though the known system provides for empty spaces to save on material, supporting and strengthening material is still needed round the recess area to provide the known system with the required strength. According to the present invention, the recesses are formed by modelling a thin sheet of material with good mechanical strength.

For shaping the shells 1, a known vacuum-forming technique is used. Each shell 1 has integral ribs 4 for enhancing the strength of the shell. The ribs are formed on the recess defining portions of the shell and define teeth 5 on the outer surface of the inner portion of each recess. The functional aspect of the system is made clearer in FIG. 2 which shows an assembly of three packages containing cathode ray tubes ready for storage or transportation.

It is important to note that this system does not require the use of an additional box for stability. In fact, the mechanical strength of the material, in a preferred example shockproof ABS (acrylonitrile-butadiene-styrene), used for making the shells, and the shape of each recess (depth, ribbing) are such that the two shells together with the cathode ray tubes are sufficiently strong and stable in themselves.

The depth of the recesses also ensures that the cathode ray tubes are kept firmly in place and separate from one another by accommodating a large part of each glass bulb. This provides for an ample supporting surface so that the centre of gravity of the system can be projected so as to fall well inside the cathode ray tube supporting surface, that is, inside the base of the solid in question.

Stability is also ensured by the forming technique which provides for minimum dimensional tolerances of the recesses so that the cathode ray tubes fit almost perfectly against the recess walls.

The strength of the system and the protection afforded by it against impact to the cathode ray tubes are guaranteed by the type of shell used, that is, its mechanical features (shockproof material) and the fact that it envelopes a large part of each cathode ray tube.

Another important point is the function of the ribs 4 which increase the resistance to bending stress of each recess.

The function of the teeth 5 is to prevent stacked shells from slipping sideways by engaging with the teeth on an adjacent inverted shell (one on top and one underneath).

Figure 2:
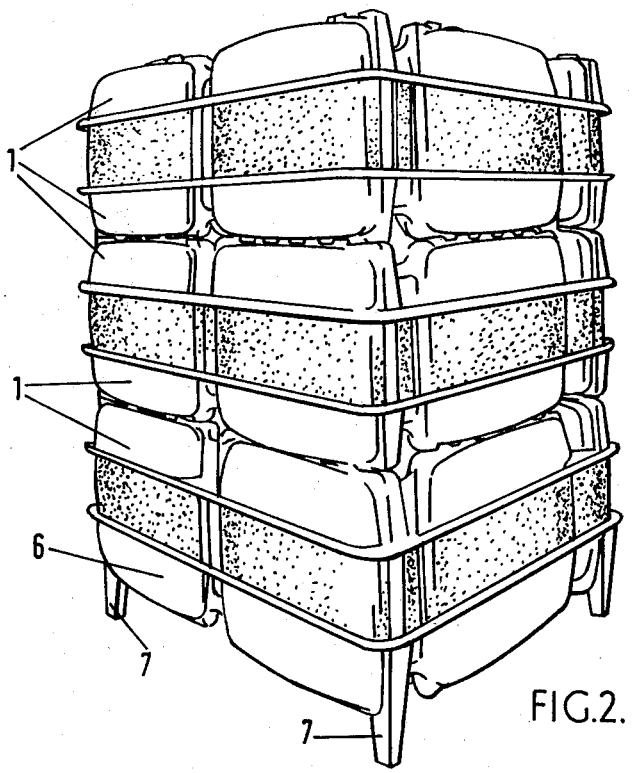
FIG. 2 shows a packed cathode ray tube assembly.

In the example shown in FIG. 2, a second shell 6, slightly different from the others 1, is used as a base for the stack and has feet 7 for raising the stack off the floor so it can be handled by fork-lift trucks.

Figure 3:
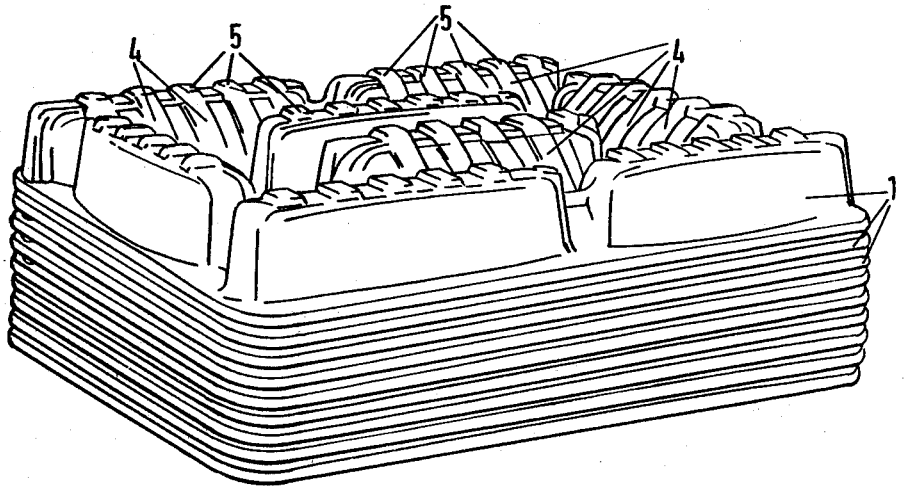
FIG. 3 shows a view in perspective of an empty packing assembly.

FIG. 3 shows a plurality of empty shells stacked one inside another.

Figure 4:
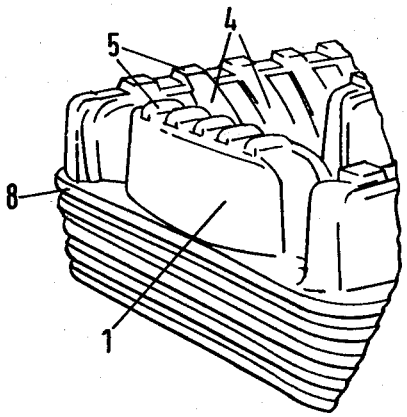
FIG. 4 shows an enlarged detail of FIG. 3.

The fact that there is no protruding material on the external side round the recesses, that a thin sheet (having a thickness of circa 4 mm) is used for making the shells, that all the shells are identical and, finally, that they are provided with a contour lip indicated in FIG. 4 by reference number 8 means that a large number of shells can be stacked easily with a large saving in the space thus occupied.

The advantages of the present invention will be clear from the above description, in particular, the reduced volume of empty packing which means transport vehicles used for recovering empties can also be loaded with other material.

Also, the packing system possesses increased strength both as regards shock resistance (the mechanical strength of the material used is far greater than that of materials commonly used in the known systems) and the stability of stacked containers (which is no longer dependent on the mechanical strength and friction resistance of a cardboard box).

A further advantage is that the packing system is practically wearproof whereas packing used in the known system can only be used a limited number of times after which it must be scrapped.

To those skilled in the art, it will be clear that many variations can be made to the cathode ray tube packing system described by way of an example without, however, departing from the scope of the present invention.

I claim:

1. A packing device for storing and transporting a plurality of items, comprising a pair of unconnected substantially identical shells, each of said shells being elongated and including a plurality of preformed elongated recesses provided in one surface thereof for defining corresponding projections on an opposite surface thereof, said recesses of each of said shells being sized, shaped, and located such that each of said recesses of a first shell of said pair of shells cooperates with a corresponding one of said recesses of a second shell of said pair of shells to firmly retain an item between said first and second shells when said first and second shells are spaced apart and mutually inverted so that said recesses in said first shell open toward said recesses in said second shell, first and second recesses of said plurality of recesses of said first shell extending along a first longitudinal edge of said first shell in end-to-end fashion, third and fourth recesses of said plurality of recesses of said first shell extending along a second longitudinal edge of said first shell in end-to-end fashion, a fifth recess of said plurality of said recesses of said first shell extending along a first lateral edge of said first shell, a sixth recess of said plurality of recesses of said first shell extending along a second lateral edge of said first shell, and a seventh recess of said plurality of recesses of said first shell extending along a longitudinal axis of said first shell between said first, second, third and fourth recesses of said first shell, said seventh recess of said first shell being sized and arranged such that a first plane extending generally laterally across said first shell passes through one of said first and second recesses of said first shell, one of said third and fourth recesses of said first shell, and said seventh recess of said first shell and such that a second plane extending generally laterally across said first shell passes through the other of said first and second recesses of said first shell, the other of said third and fourth recesses of said first shell, and said seventh recess of said first shell, and first and second recesses of said plurality of recesses of said second shell extending along a first longitudinal edge of said second shell in end-to-end fashion, third and fourth recesses of said plurality of recesses of said second shell extending along a second longitudinal edge of said second shell in end-to-end fashion, a fifth recess of said plurality of recesses of said second shell extending along a first lateral edge of said second shell, a sixth recess of said plurality of recesses of said second shell extending along a second lateral edge of said second shell, and a seventh recess of said plurality of recesses of said second shell extending along a longitudinal axis of said second shell between said first, second, third, and fourth recesses of said second shell, said seventh recess of said second shell being sized and arranged such that a third plane extending generally laterally across said second shell passes through one of said first and second recesses of said second shell, one of said third and fourth recesses of said second shell, and said seventh recess of said second shell and such that a fourth plane extending generally laterally across said second shell passes through the other of said first and second recesses of said second shell, the other of said third and fourth recesses of said second shell, and said seventh recess of said second shell.

2. A packing device according to claim 1, further comprising strengthening ribs on said projections.

3. A packing device according to claim 2, wherein said ribs are formed integrally with said projections.

4. A packing device according to claim 1, further comprising first means on said projections of said first shell for meshing with teeth provided on a third shell when said first and third shells are stacked one on top of the other and second means on said projections of said second shell for meshing with teeth provided on a fourth shell when said second and fourth shells are stacked one on top of the other.

5. A packing device according to claim 1, wherein each of said first and second shells is formed from a sheet of material having a thickness of about 4 millimeters.

6. A packing device according to claim 1, wherein said first and second shells are vacuum formed.

7. A packing system according to claim 1, wherein each of said first and second shells is made from a synthetic resin material.

8. A packing device according to claim 7, wherein said material is shockproof ABS (acrylonitrile-butadiene-styrene).

9. A packing device according to claim 1, wherein each of said first and second shells has a peripheral lip.

10. A packing device according to claim 1, wherein said first shell includes first support means for supporting said first shell a distance from a surface and said second shell includes second support means for supporting said second shell a distance from a surface.

11. A packing device according to claim 1, wherein said recesses are shaped and sized so as to receive cathode ray tubes, said first and second shells being spaced apart by said cathode ray tubes.

12. A packing device according to claim 1, wherein said recesses are sized, shaped, and located such that said first and second shells are stackable one inside the other when said recesses are not supporting items therein.

13. In combination, a plurality of cathode ray tubes and a packing device for storing and transporting said cathode ray tubes, said device including a pair of unconnected substantially identical shells, each of said shells being elongated and including a plurality of preformed elongated recesses provided in one surface thereof for defining corresponding projections on an opposite surface thereof, said recesses of each of said shells being sized, shaped, and located such that each of said recesses of a first shell of said pair of shells cooperates with a corresponding one of said recesses of a second shell of said pair of shells to firmly retain a corresponding one of said cathode ray tubes between said first and second shells when said first and second shells are spaced apart by said cathode ray tubes and mutually inverted so that said recesses in said first shell open toward said recesses in said second shell, first and second recesses of said plurality of recesses of said first shell extending along a first longitudinal edge of said first shell in end-to-end fashion, third and fourth recesses of said plurality of recesses of said first shell extending along a second longitudinal edge of said first shell in end-to-end fashion, a fifth recess of said plurality of recesses of said first shell extending along a first lateral edge of said first shell, a sixth recess of said plurality of recesses of said first shell extending along a second lateral edge of said first shell, and a seventh recess of said plurality of recesses of said first shell extending along a longitudinal axis of said first shell between said first, second, third, and fourth recesses of said first shell, said seventh recess of said first shell being sized and arranged such that a first plane extending generally laterally across said first shell passes through one of said first and second recesses of said first shell, one of said third and fourth recesses of said first shell, and said seventh recess of said first shell and such that a second plane extending generally laterally across said first shell passes through the other of said first and second recesses of said first shell, the other of said third and fourth recesses of said first shell, and said seventh recess of said first shell, and first and second recesses of said plurality of recesses of said second shell extending along a first longitudinal edge of said second shell in end-to-end fashion, third and fourth recesses of said plurality of recesses of said second shell extending along a second longitudinal edge of said second shell in end-to-end fashion, a fifth recess of said plurality of recesses of said second shell extending along a first lateral edge of said second shell, a sixth recess of said plurality of recesses of said second shell extending along a second lateral edge of said second shell, and a seventh recess of said plurality of recesses of said second shell extending along a longitudinal axis of said second shell between said first, second, third, and fourth recesses of said second shell, said seventh recess of said second shell being sized and arranged such that a third plane extending generally laterally across said second shell passes through one of said first and second recesses of said second shell, one of said third and fourth recesses of said second shell, and said seventh recess of said second shell and such that a fourth plane extending generally laterally across said second shell passes through the other of said first and second recesses of said second shell, the other of said third and fourth recesses of said second shell, and said seventh recess of said second shell.

14. A combination according to claim 13, further comprising strengthening ribs on said projections.

15. A combination according to claim 14 wherein said ribs are formed integrally with said projections.

16. A combination according to claim 13, further comprising first means on said projections of said first shell for meshing with teeth provided on a third shell when said first and third shells are stacked one on top of the other and second means on said projections of said second shell for meshing with teeth provided on a fourth shell when said second and fourth shells are stacked one on top of the other.

17. A combination according to claim 13, wherein each of said first and second shells is formed from a sheet of material having a thickness of about 4 millimeters.

18. A combination according to claim 13, wherein said first and second shells are vacuum formed.

19. A combination according to claim 13, wherein each of said first and second shells is made from a synthetic resin material.

20. A combination according to claim 16, wherein said material is shockproof ABS (acrylonitrile-butadiene-styrene).

21. A combination according to claim 13, wherein each of said first and second shells has a peripheral lip.

22. A combination according to claim 13, wherein said first shell includes first support means for supporting said first shell a distance from a surface and said second shell includes said second support means for supporting said second shell a distance from a surface.

23. A combination according to claim 13, wherein said recesses are sized, shaped, and located such that said first and second shells are stackable one inside the other when said recesses are not supporting items therein.

* * * * *